US007683853B2

(12) United States Patent
Michaelis

(10) Patent No.: US 7,683,853 B2
(45) Date of Patent: Mar. 23, 2010

(54) NON-INVASIVE ANTENNA MOUNT

(76) Inventor: Sean Michaelis, 3453 Indian Peak Dr., Lake Havasu City, AZ (US) 86406

( * ) Notice: Subject to any disclaimer, the term of this patent is extended or adjusted under 35 U.S.C. 154(b) by 603 days.

(21) Appl. No.: 11/467,911

(22) Filed: Aug. 28, 2006

(65) Prior Publication Data

US 2008/0048928 A1 Feb. 28, 2008

(51) Int. Cl.
*H01Q 1/12* (2006.01)

(52) U.S. Cl. ..... 343/878; 343/880; 343/882; 343/888; 343/879

(58) Field of Classification Search ..... None
See application file for complete search history.

(56) References Cited

U.S. PATENT DOCUMENTS

| | | | | |
|---|---|---|---|---|
| 2,985,228 | A * | 5/1961 | Golden | 297/409 |
| 5,142,293 | A * | 8/1992 | Ross | 343/840 |
| 6,366,253 | B1 * | 4/2002 | Hemmingsen, II | 343/760 |
| 6,445,361 | B2 * | 9/2002 | Liu et al. | 343/882 |
| 2003/0122728 | A1 * | 7/2003 | Antoine | 343/878 |

* cited by examiner

*Primary Examiner*—Trinh V Dinh
(74) *Attorney, Agent, or Firm*—Krueger Intellectual Property, Inc.; Scott C. Krieger

(57) ABSTRACT

Embodiments of the present invention comprise an antenna mounting apparatus and installation methods for a non-invasive antenna mounting system.

7 Claims, 7 Drawing Sheets

NON-INVASIVE ANTENNA MOUNT

FIELD OF THE INVENTION

Embodiments of the present invention comprise methods and systems for producing, mounting and using a non-invasive antenna mount.

BACKGROUND

Many residential and commercial buildings today utilize communication services that require a local antenna mounted on the building. These antennas may transmit and receive communication signals for computer networks, telephone services, video services and many other communication tasks. For many services, antenna performance is increased when the antenna is mounted near the top of the building. This placement will generally avoid more interference from neighboring structures, trees, hills and other objects. When an antenna is receiving a signal from a specific source, such as a satellite or a base station, the antenna may need to be oriented in a particular direction to optimize performance. In some cases, the antenna may need a direct line-of-sight to the signal transmitter or receiver. When this is the case, it is generally preferred that the antenna be mounted near the top of the building and oriented toward the transmitter or receiver with which it will communicate. This location and orientation will typically optimize antenna performance. Because of the complexity or antenna installation and orientation, this process is generally performed by a professional.

For many communication applications, the antenna may be supplied and installed by a service provider. When a building owner or tenant contracts for communication services, the service provider will visit the location and, in conjunction with the owner or tenant, determine an acceptable antenna location. In many cases, installation of the antenna may result in invasive procedures, such as drilling and cutting of building components. Often rafters, siding, roofing and other components are compromised during antenna installation. When this is performed properly, routine maintenance may prevent permanent damage to the structure.

However, due to the changing availability and economy of communication services and the transient tenancy of many buildings, such as apartments, the installation of the antenna may need to be modified or relocated multiple times. For example, in an apartment building, a typical tenancy may last for only one year or even less. If each tenant subscribes to a different communication service provider or if each change of tenancy requires removal of the previous tenants equipment, many iterations of antenna mounting and removal may take place during the life of the building. If each installation process requires invasive cutting and drilling, the building component will soon be compromised and the building will need to be repaired. In some case installation and removal of antenna mounting brackets may result in cuts and holes in building component that invite further damage from rot, insect infestation and other sources.

Because of the complex relationship between successive owners, landlords, tenants and third-party service providers, this type of damage to the building can cause liability issues that are difficult to resolve and sometimes difficult to detect. For these reasons, a non-invasive antenna mount that does not cause building component damage is desirable.

Antenna mounting performed high on a building or other structure also presents a challenge to the installer who must typically work from a ladder, lift or other device to gain access to the installation location. Generally, the installer must work in a difficult position and demonstrate heightened dexterity to accomplish the installation. Maintaining the antenna or mounting device in the proper position while affixing the mounting bracket to the structure can be a challenge, especially when an installer is working alone on a ladder. For this reason, a mount or mounting hardware that provides a simple and quick installation procedure is also desirable.

SUMMARY

Some embodiments of the present invention comprise an antenna mount and installation method that do not require invasive installation procedures. In some embodiments, the antenna mount may be installed and removed without any significant damage or change to the building components to which it was attached.

Some embodiments of the present invention comprise a non-invasive attachment device and an orientation device that allow the antenna orientation to be adjusted once the antenna mount is fixed to the building.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

Figure 7:
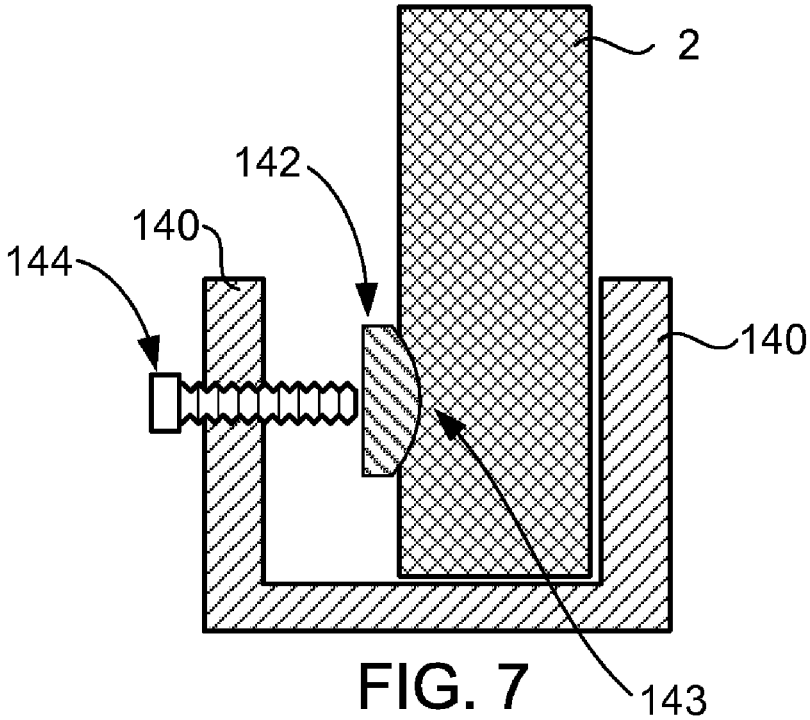
Figure 8:
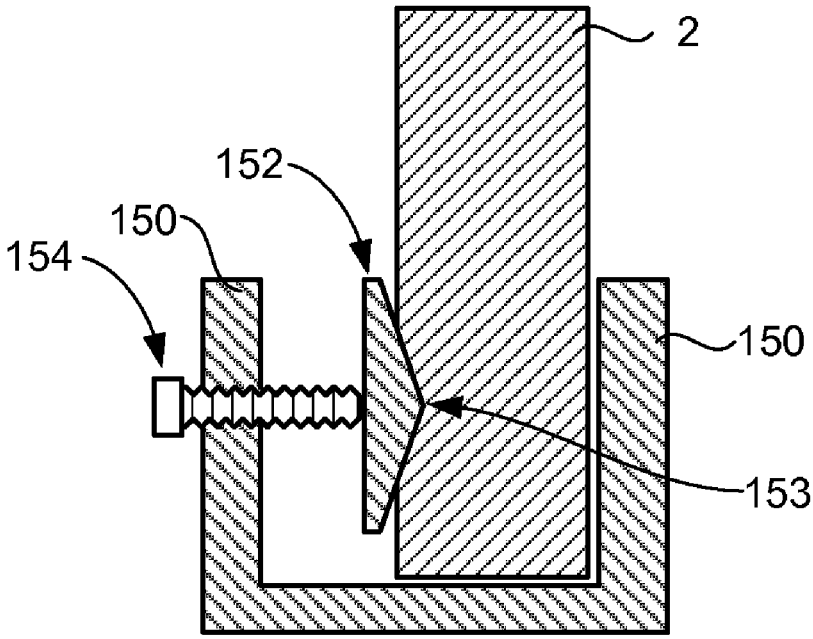

FIG. 7 is a diagram of an alternative clamping device exemplary of some embodiments of the present invention wherein a convex compression member induces a differential stress in a structure component; and FIG. 8 is a diagram of an alternative clamping device exemplary of some embodiments of the present invention wherein a conical compression member induces a differential stress in a structure component

DETAILED DESCRIPTION OF EXEMPLARY EMBODIMENTS

Embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

A non-invasive equipment mount is one that does not require penetration of a building component for proper support of the mounted equipment. Drilling and cutting of building components are considered invasive procedures because they leave permanent holes or cuts in the building components. A non-invasive mount may comprise a compression device that connects the mount to a building component. The compression device may comprise opposing elements that are locked around a building or structure component in a process that maintains a compressive force on the component. When in this locked position, the elements maintain sufficient force on the building or structure component to provide enough friction to support the mounted equipment's support requirements. In some embodiments, a compressive device may comprise a screw-actuated clamp, a hydraulically actuated clamp, a spring actuated clamp, an electrically actuated clamp or some other clamping actuation means.

Figure 1:
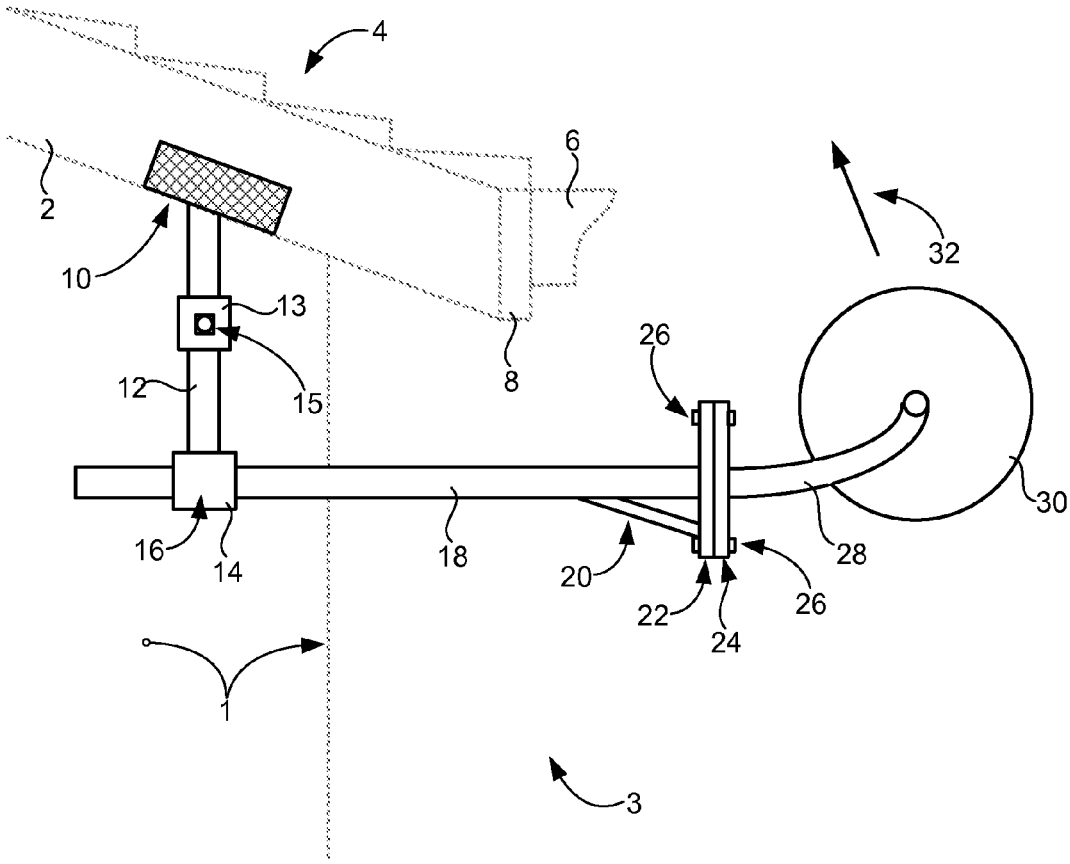
FIG. 1 is a diagram of an antenna mounting apparatus exemplary of some embodiments of the present invention.

Some embodiments of the present invention may be described with reference to FIG. 1. In these embodiments, an antenna 30 is mounted to a building or structure 1 with a non-invasive antenna mount 3. In a typical building installation, the building may comprise a component 2, such as a rafter, beam, stud, railing, column or other structural member or building component. The building may also comprise roofing 4, a fascia board 8 or other trim and a gutter 6.

In these embodiments, the non-invasive antenna mount may comprise a clamping device 10, a drop arm 12, an extension arm 18 and an antenna bracket 28. In some embodiments, the non-invasive antenna mount may also comprise an extension arm connector 14 and an extension arm adjustment set 16, such as a set screw. In some embodiments, the non-invasive antenna mount may also comprise an antenna adjustment flange comprising an extension arm plate 22, an antenna bracket plate 24, flange mounting bolts 26 and a plate brace 20. In some embodiments, the antenna adjustment flange may allow adjustment of the antenna orientation by providing adjustable rotation of the antenna bracket plate 24 around the axis of the extension arm 18. In some embodiments, the antenna adjustment flange may provide for rotation about some other axis or may provide other adjustments with other degrees of freedom.

In some embodiments, extension arm connector 14 may be a circular tube with dimensions that allow the extension arm 18 to run through the connector 14 with a slidable fit thus allowing rotation of extension arm 18 about its longitudinal axis. This rotatable freedom may be fixed once adjusted to a desirable position using an extension arm adjustment set 16. The slidable fit of extension arm 18 in extension arm connector 14 may also allow extension or retraction of extension arm 18 in extension arm connector 14 thereby allowing the antenna to be mounted more closely or more distal to drop arm 12 and the building 1. Extension arm adjustment set 16 may also fix the longitudinal position of extension arm 18 within extension arm connector 14.

In some embodiments, drop arm 12 may comprise an adjustment device 13 that allows for rotational adjustment of drop arm 12 about its longitudinal axis. Adjustment device 13 may also provide for longitudinal extension and retraction of drop arm 12. This rotational and longitudinal adjustment may be fixed with drop arm adjustment set 15, which may comprise a set screw. In some embodiments, adjustment device 13 and adjustment set 15 may be combined in an indexed device allowing gradated adjustment with a spring-loaded set mechanism or some other set device.

Figure 2:
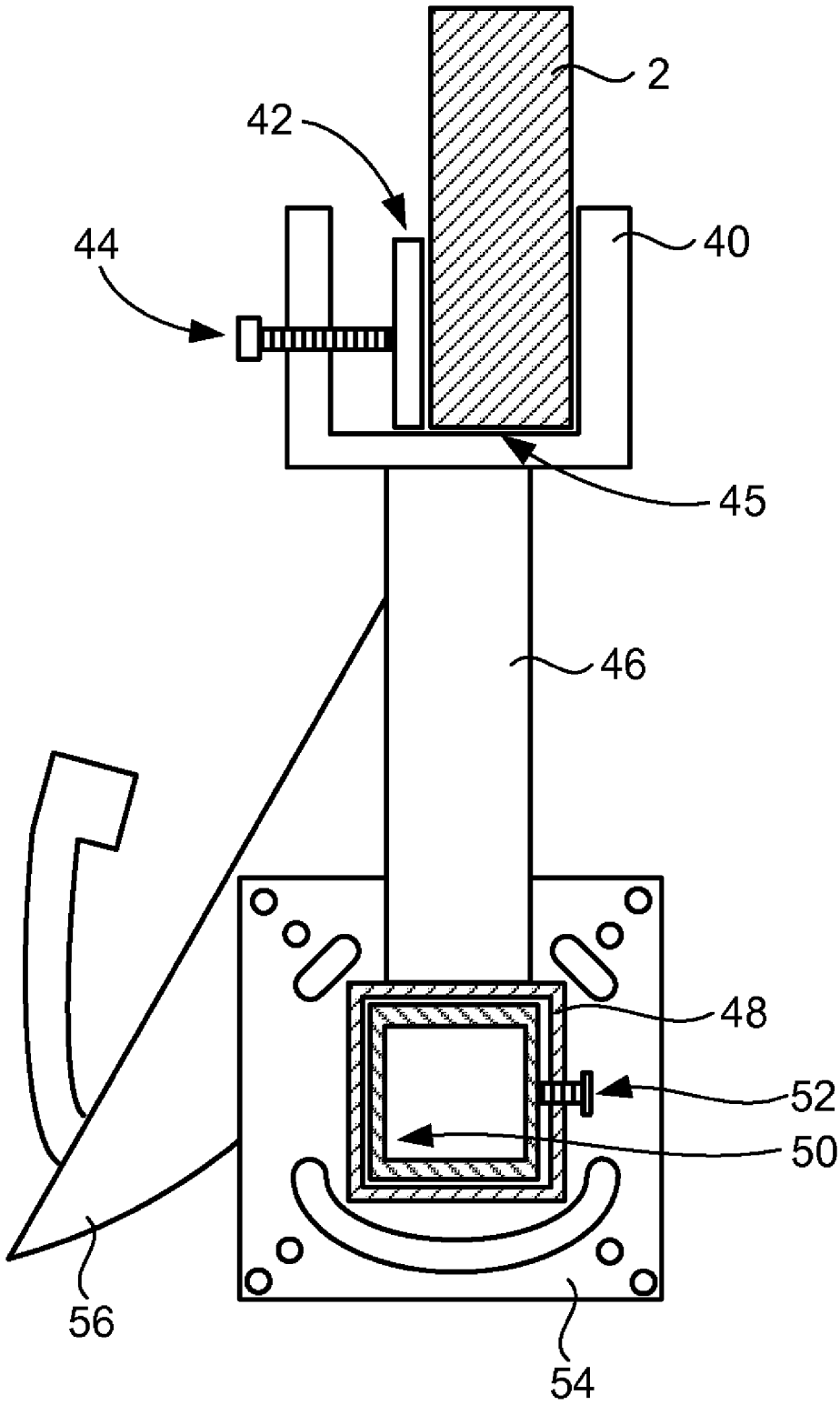
FIG. 2 is a diagram of an alternative antenna mounting apparatus exemplary of some embodiments of the present invention.

Some embodiments of the present invention may be described with reference to FIG. 2. In these embodiments, an antenna mount is connected to a building or structure component 2. The antenna mount comprises opposing clamp arms 40, a compression member 42 and a compression device 44. In some embodiments, compression device 44 may comprise a screw mechanism, a hydraulic mechanism, a spring mechanism, an electrically actuated mechanism or some other compression-inducing device.

In some embodiments, compression device 44 and compression member 42 may be configured to induce a differential compressive stress in component 2. In some embodiments, the differential compressive stress will increase as the distance from proximate component edge 45 increases. When this occurs, the compressive strain of component 2 will cause component 2 to become narrower as the distance from proximate edge 45 increases thereby creating a wedge shape that will resist removal of the antenna mount from component 2.

In these embodiments, the antenna mount may also comprise a drop arm 46 connected to the clamp arms 40. Drop arm 46 may comprise an extension arm connector 48 that provides for attachment of an extension arm 50. An extension arm connector set 52 may fix the position of the extension arm 50 within the extension arm connector 48. In the exemplary embodiment shown in FIG. 2, extension arm 50 has a square cross-section. In other embodiments, other cross-sectional shapes may be used, including, but not limited to, circular, elliptical, rectangular, triangular, trapezoidal and other shapes.

In some embodiments, extension arm 50 may be connected to an extension arm plate 54 that may provide a surface for mounting an antenna 56 or its associated hardware.

Figure 3:
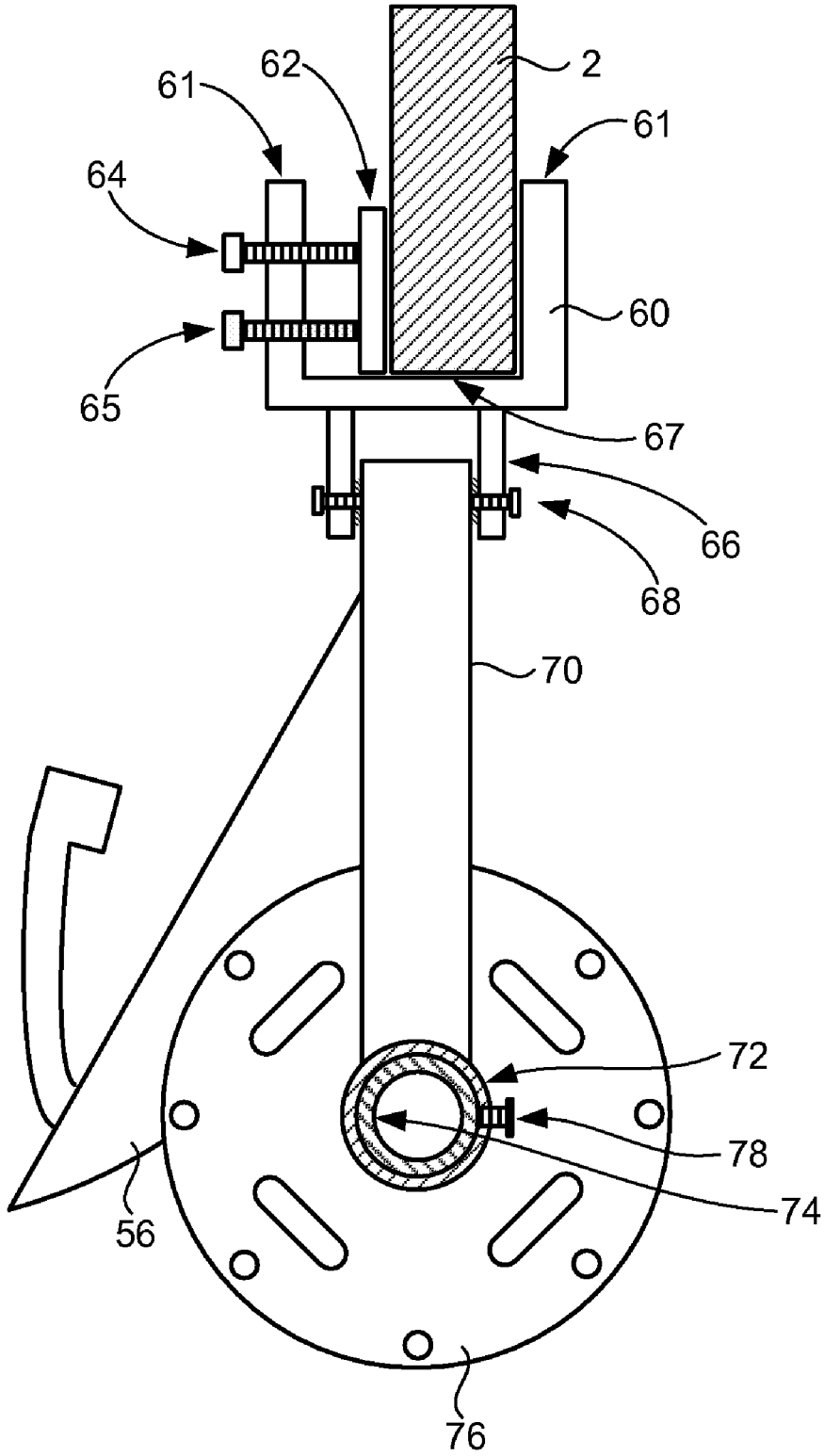
FIG. 3 is a diagram of an alternative antenna mounting apparatus exemplary of other embodiments of the present invention.

Elements of some embodiments of the present invention may be described with reference to FIG. 3. In these embodiments, the opposing arms 61 of a clamping device 60 are positioned around a building or structure component 2 and a compression member 42 is driven against component 2 by compression devices 64 and 65. The opposing arms 61, compression member 62 and compression devices 64 and 65 may be configured to induce an increased compressive stress in component 2 as the distance from proximate edge 67 increases. In some embodiments this differential stress may be induced by the shape of compressive member 62, in other embodiments this differential stress may be induced by the configuration of compressive device 64 and 65.

Some embodiments may also comprise drop arm flanges 66 that provide an adjustable connection to a drop arm 70. The drop arm 70 may be connected to the drop arm flanges 66 by a drop arm fastener 68 such as a bolt, pin or other fastener. This adjustable connection allows the drop arm 70 to be adjusted to a vertical position or some other position to account for varying roof slopes and other factors. In some embodiments, the drop arm 70 may be connected to an extension arm connector 72 to provide an adjustable connection to an extension arm 74 as described above for other embodiments. This connection may be fixed by an extension arm connector set 78. In some embodiments, the extension arm 74 may be connected directly to the drop arm 70 with a static connection such as a weld or may be formed from a single element, such as bent tube.

In some embodiments, an extension arm 74 may be connected to an antenna mounting plate 76 that provides for mounting of an antenna 56 and any associated hardware. The antenna mounting plate 76 may provide for mounting of the antenna 56 in various positions as allowed by multiple bolt patterns and rotational adjustability.

Elements of some embodiments of the present invention may be described with reference to FIG. 4. In these embodiments, the arm of an antenna mount 88 is attached to a clamping device comprising opposing clamp arms 82, a compression member 86 and a compression device comprising a proximate compression device 84*b* and a distal compression device 84*a*. Some embodiments may comprise a compression liner 80, which may protect component 2 from compression damage, increase friction between component 2 and opposing arm 82 and between compression member 86 and component 2, prevent moisture from entering between component 2 and compression member 86 or arm 82 and perform other functions.

Figure 4:
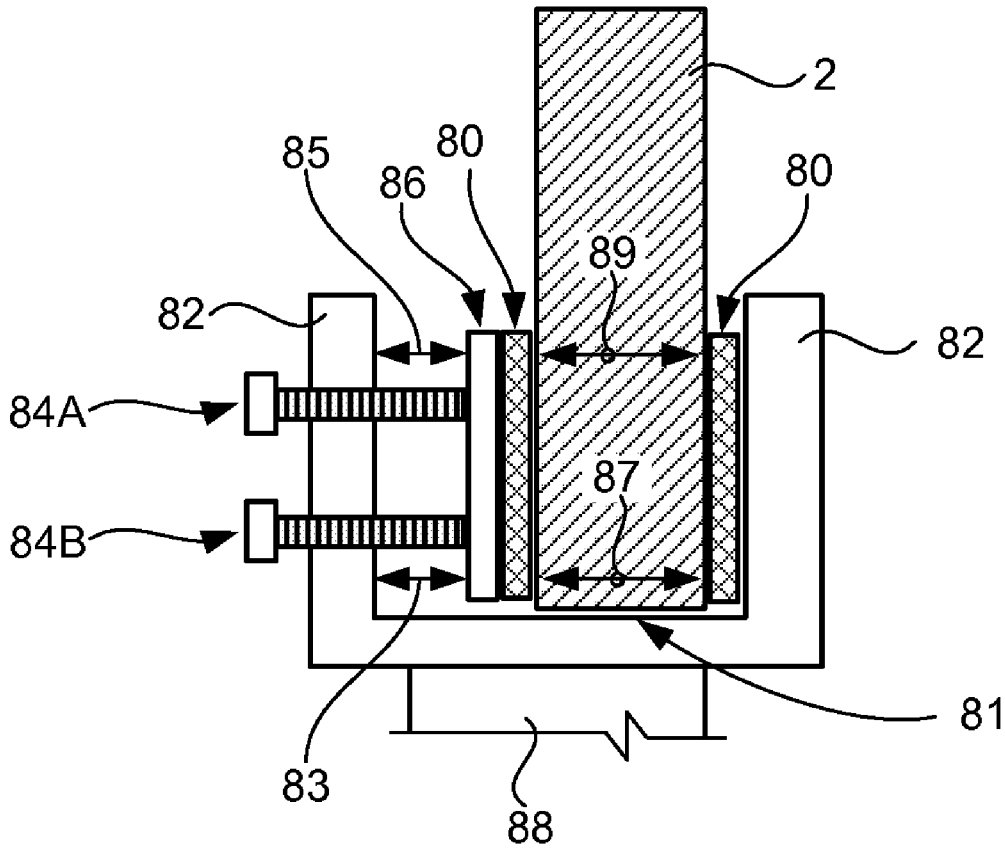
FIG. 4 is a diagram of a clamping device exemplary of some embodiments of the present invention.

In the exemplary embodiments shown in FIG. 4, screw-type compression devices 84*a* and 84*b* are illustrated, however many other types of compression devices may be used in other embodiments as explained above for other embodiments. In some embodiments, the distal compression device 84*a* may be configured to provide more compression on component 2 than the proximate compression device 84*b* thereby causing a differential stress in component 2 that will pinch component 2 into a wedge shape wherein a distal dimension 89 is shorter than a proximate dimension 87. This differential stress situation may serve to "lock" the antenna mount to the component 2.

Figure 5:
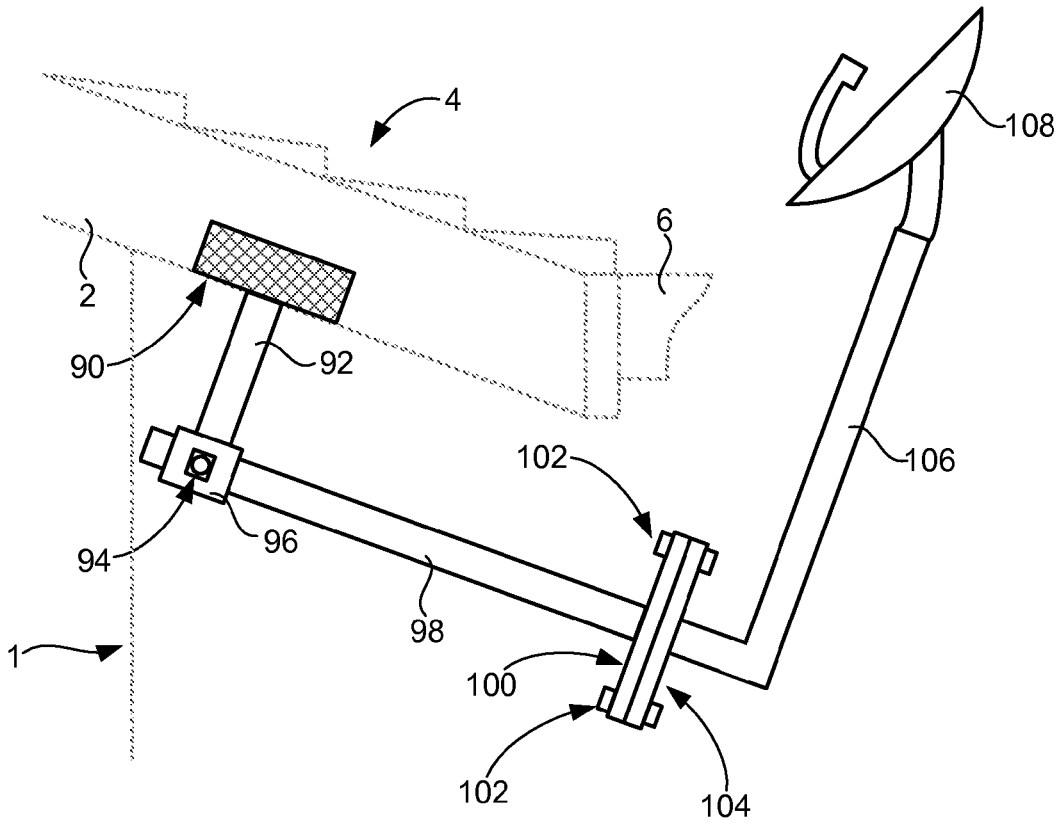
FIG. 5 is a diagram of an alternative antenna mounting apparatus exemplary of some embodiments of the present invention wherein the antenna is oriented predominantly upslope.

Some embodiments of the present invention may be described with reference to FIG. 5. In these embodiments, an antenna mounting device may be connected to a building component 2. A building 1 may also comprise roofing 4, trim or fascia 8, a gutter 6 and/or other components. In these embodiments, the antenna mounting device may comprise a clamping device 90, a drop arm 92, an extension arm 98 and an extension arm flange 100 each being connected to the next in succession. Clamping device 90 may be configured similarly to embodiments described in relation to FIG. 4 or may have another configuration. In some embodiments, drop arm 92 may be directly connected to extension arm 98 with a rigid connection. In other embodiments, drop arm 92 may be connected to an extension arm connector 96, which allows adjustment of the position and/or rotation of extension arm 98. This adjustment may be fixed with adjustment set 94. An antenna 108 may be attached to the antenna mount with an antenna bracket 106 and antenna mounting flange 104 that is configured to mate to extension arm flange 100 with fasteners 102. The configuration and orientation of antenna mounting flange 104 and extension arm flange 100 may provide adjustment of the antenna 108 orientation.

Figure 6:
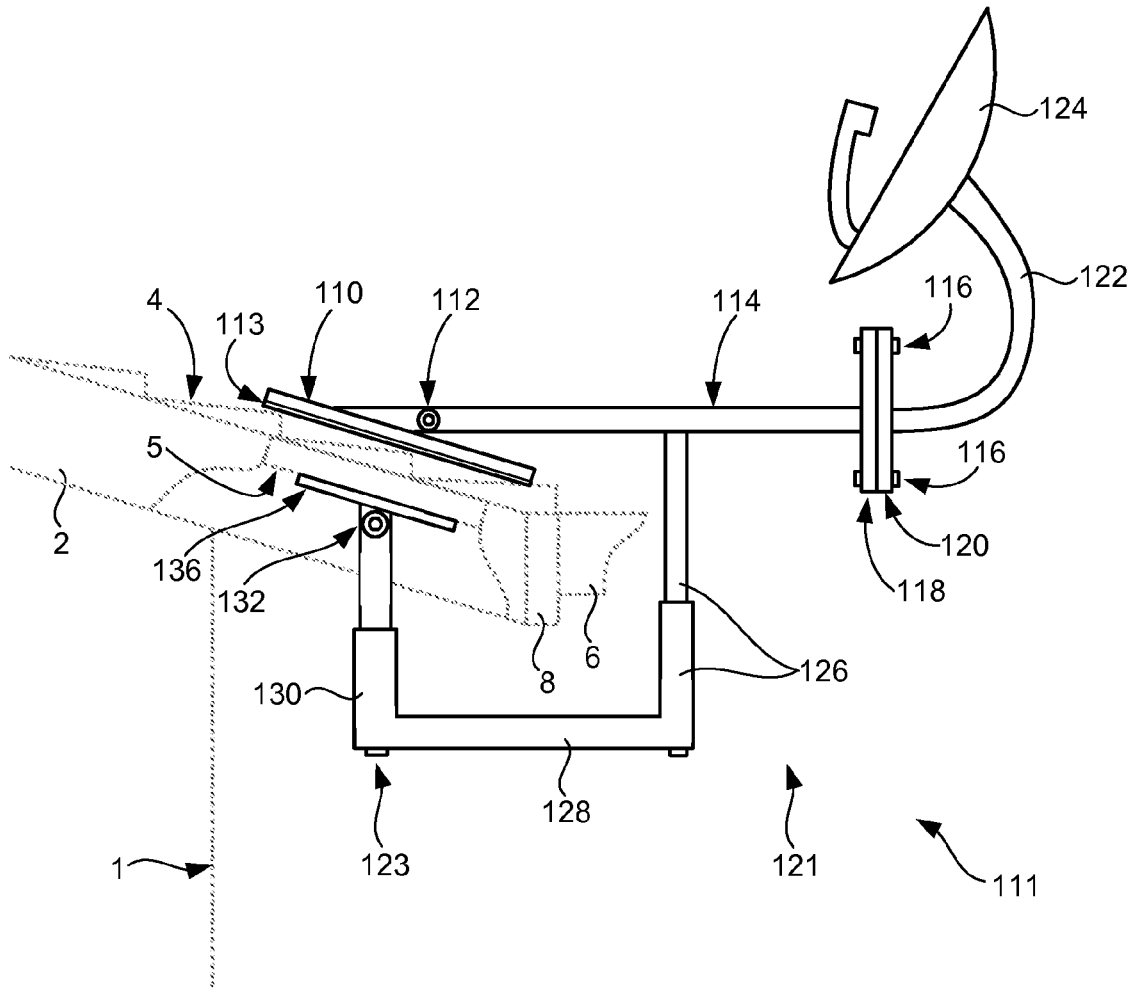
FIG. 6 is a diagram of an alternative antenna mounting apparatus exemplary of some embodiments of the present invention wherein the apparatus uses compression against the roof surface.

Further embodiments of the present invention may be described with reference to FIG. 6. In these embodiments, an antenna mounting device 111 may be attached to a building 1 by clamping against the roofing surface 4. The building 1 may also comprise a roof structural component 2, a fascia or trim board 8 and a gutter 6. In these embodiments, a roof plate 110 is attached to an upper extension arm 114 through an angular connector 112. Angular connector 112 may be an adjustable connector that can be adjusted for various roof slopes or may be fixed at a constant angle for standard applications. The upper extension arm 114 may be attached to an outside drop arm 126, which may be attached to a lower extension arm 128, which may be, in turn, connected to an inside drop arm 130. The inside drop arm 130 may also be connected to a compression member 136, which may be compressed against a building component 5, such a roof sheathing or soffit material.

In some embodiments, the interface between roof plate 110 and roofing material 4 may be lined with a roofing liner 113, which may serve to protect the roofing material 4, increase friction between the roofing material 4 and the roof plate 110, provide a releasable adhesive between the roofing material 4 and the roof plate 110, prevent moisture from entering between roofing material 4 and roof plate 110 and other functions. In some embodiments, an extension arm flange 118 may mate with an antenna bracket flange 120 to which it may be secured with fasteners 116 or by other means. The antenna bracket flange 120 may provide support for an antenna bracket 122 and an antenna 124.

In some embodiments, outside drop arm 126 may be extensible and retractable in a telescoping manner so as to cause compression between roof plate 110 and compression member 136. As outside drop arm 126 shortens, compression will occur between roof plate 110 and compression member 136 if all other members remain rigid.

Likewise, in some embodiments, inside drop arm 130 may be extensible and retractable in a telescoping manner so as to apply a compressive force between roof plate 110 and compression member 136.

Elements of some embodiments of the present invention may be described with reference to FIG. 7. In these embodiments, opposing clamp arms 140 are positioned on either side of a building or structure component 2 and a compression device 144 forces a protruding compression member 142 against the component 2. In the exemplary embodiment illustrated in FIG. 7, the protruding compression member 142 has a convex surface 143, which induces a differential stress in component 2 when compression member 142 is compressed against component 2 by compression device 144.

Elements of some embodiments of the present invention may be described with reference to FIG. 8. In these embodiments, opposing clamp arms 150 are positioned on either side of a building or structure component 2 and a compression device 154 forces a protruding compression member 152 against the component 2. In the exemplary embodiment illustrated in FIG. 8, the protruding compression member 152 has a conical surface 153, which induces a differential stress in component 2 when compression member 152 is compressed against component 2 by compression device 154.

The terms and expressions which have been employed in the foregoing specification are used therein as terms of description and not of limitation, and there is no intention in the use of such terms and expressions of excluding equivalence of the features shown and described or portions thereof, it being recognized that the scope of the invention is defined and limited only by the claims which follow.

What is claimed is:

1. A non-invasive antenna mounting apparatus for mounting an antenna on a structure, said apparatus comprising:

a) a clamping device for compressing a structure component, said clamping device comprising opposing arms, a compression device and a compression member, wherein said clamping device serves to attach said apparatus to a structure by compressing said structure component such that said clamping device is rigidly attached to said structure component as a result of said compressing;

b) a drop arm segment;

c) an extension arm segment, d) an extension arm connector:

e) wherein said drop arm segment is attached to said clamping device at a first end of said drop arm segment and said drop arm segment is attached to said extension arm segment at a second end of said drop arm segment with said extension arm connector and wherein said extension arm connector allows a position of said extension arm to be adjusted within said extension arm connector, thereby adjusting the effective length of said extension arm; and f) a mounting plate configured to couple with an antenna bracket while allowing selective rotation of said antenna bracket, said mounting plate providing support for an antenna connected to said antenna bracket, wherein said mounting plate is attached to an end of said extension arm.

2. An apparatus as described in claim 1 wherein said drop arm segment allows for selective rotation about its axis.

3. An apparatus as described in claim 1 wherein said extension arm segment allows for selective rotation about its axis.

4. An apparatus as described in claim 1 wherein said drop arm segment allows for selective extension and retraction along its axis.

5. An apparatus as described in claim 1 wherein said extension arm segment allows for selective extension and retraction along its axis.

6. An apparatus as described in claim 1 wherein said compression device is configured to induce a differential compressive stress in a structure component, wherein the differential compressive stress increases as the distance from a proximate edge increases.

7. An apparatus as described in claim 1 wherein said compression member comprises a protruding compression member shaped to induce a differential compressive stress in said structure component.

* * * * *